United States Patent [19]

Wessel et al.

[11] 4,170,975

[45] Oct. 16, 1979

[54] FUEL METERING VALVE ASSEMBLY FOR INTERNAL COMBUSTION ENGINES

[75] Inventors: Wolf Wessel, Oberriexingen; Hermann Grieshaber; Siegfried Holzbaur, both of Stuttgart, all of Fed. Rep. of Germany

[73] Assignee: Robert Bosch GmbH, Stuttgart, Fed. Rep. of Germany

[21] Appl. No.: 839,675

[22] Filed: Oct. 5, 1977

[30] Foreign Application Priority Data

Oct. 7, 1976 [DE] Fed. Rep. of Germany ..... 2645214

[51] Int. Cl.[2] ..... F02M 39/00

[52] U.S. Cl. ..... 123/139 AW; 261/50 A; 261/88

[58] Field of Search ..... 123/139 AW; 261/50 A, 261/44 D, 88; 251/205

[56] References Cited

U.S. PATENT DOCUMENTS 3,920,778 11/1975 De Rugeris ..... 261/50 A X 3,953,547 4/1976 Schoeman ..... 261/50 A X 4,090,486 5/1978 Stumpp ..... 261/50 A X

*Primary Examiner*—Alan Cohan

*Attorney, Agent, or Firm*—Edwin E. Greigg

[57] ABSTRACT

A fuel metering valve assembly includes an air flow metering member which actuates the movable part of a fuel metering valve. Depending on the displacement of this movable part, two cooperating openings, a control slot and a shaped control orifice, together define the effective flow cross section for the fuel delivered to the engine. In order to improve the resolution of the path of the moving part of the valve assembly, one of the cooperating openings, e.g. the control orifice, is formed as a triangular opening in a sleeve or bushing surrounding an axially slidable shaft which supports the air flow rate-responsive member. The triangular opening may also be defined within the wall of the shaft. The width of the control slot is defined by a spacer ring between two coaxial partial bushings and one edge of the triangular opening is defined by the oblique line separating two partial sleeves.

16 Claims, 4 Drawing Figures

FUEL METERING VALVE ASSEMBLY FOR INTERNAL COMBUSTION ENGINES

BACKGROUND OF THE INVENTION

The invention relates to a fuel injection system. More particularly, the invention relates to a fuel metering valve assembly within a fuel injection system which contains a movable valve member that is actuated by an air flow rate meter responsive to the aspirated air flow rate in the engine. The fuel injection system is intended to provide a combustible mixture to mixture-compressing and spark plug-ignited internal combustion engines. The fuel metering valve includes cooperating control slots and control orifices with variable flow apertures so as to provide metered fuel flow. A fuel metering valve of this type is already known. However, the constantly increasing requirements regarding the precision of the metered out fuel quantity make it necessary in the known fuel injection metering valve to use the most modern and precise manufacturing techniques, for example spark erosion, in order to obtain the exactly calibrated control orifices and control slots. Furthermore, the resolution of the path of the motion of the air flow rate meter is limited in the known fuel metering valve and thus only permits a limited adaptation of the fuel quantity to the requirements of the engine.

OBJECT AND SUMMARY OF THE INVENTION

It is a principal object of the invention to provide a fuel metering valve for a fuel injection system which is distinguished with respect to the known technology by being more compact and smaller in construction and by being able to increase the efficiency of the engine, while at the same time reducing fuel consumption and the toxicity of the exhaust gases. This object would be met by providing a fuel metering valve which is capable of being produced with simpler methods than are heretofore possible to provide a control slot and control orifices of great precision.

These and other objects are attained by providing a fuel metering valve which includes a movable valve member that contains a control slot which cooperates with a control orifice, wherein the control orifice is defined by a bushing surrounding the movable valve member. In particular, the bushing may be a split bushing and adjacent edges of the split bushing define the extent of the control slot. In a favorable feature of the invention, the distance between the two split partial bushings is defined by a spacer ring.

Yet another advantageous feature of the invention is that the control orifice for the fuel metering valve is triangular in shape which permits an improved resolution of the motion of the air flow rate meter which actuates the metering valve and thus permits a greater precision of adapting the fuel quantity to the requirements of the engine.

The adaptation to the requirements of the engine may be further improved by providing one of the side surfaces of the triangular control orifice with a correcting contour.

The invention will be better understood as well as further objects and advantages thereof become more apparent from the ensuing detailed description of two preferred embodiments taken in conjunction with the drawing.

DESCRIPTION OF THE PREFERRED EMBODIMENTS

Figure 1:
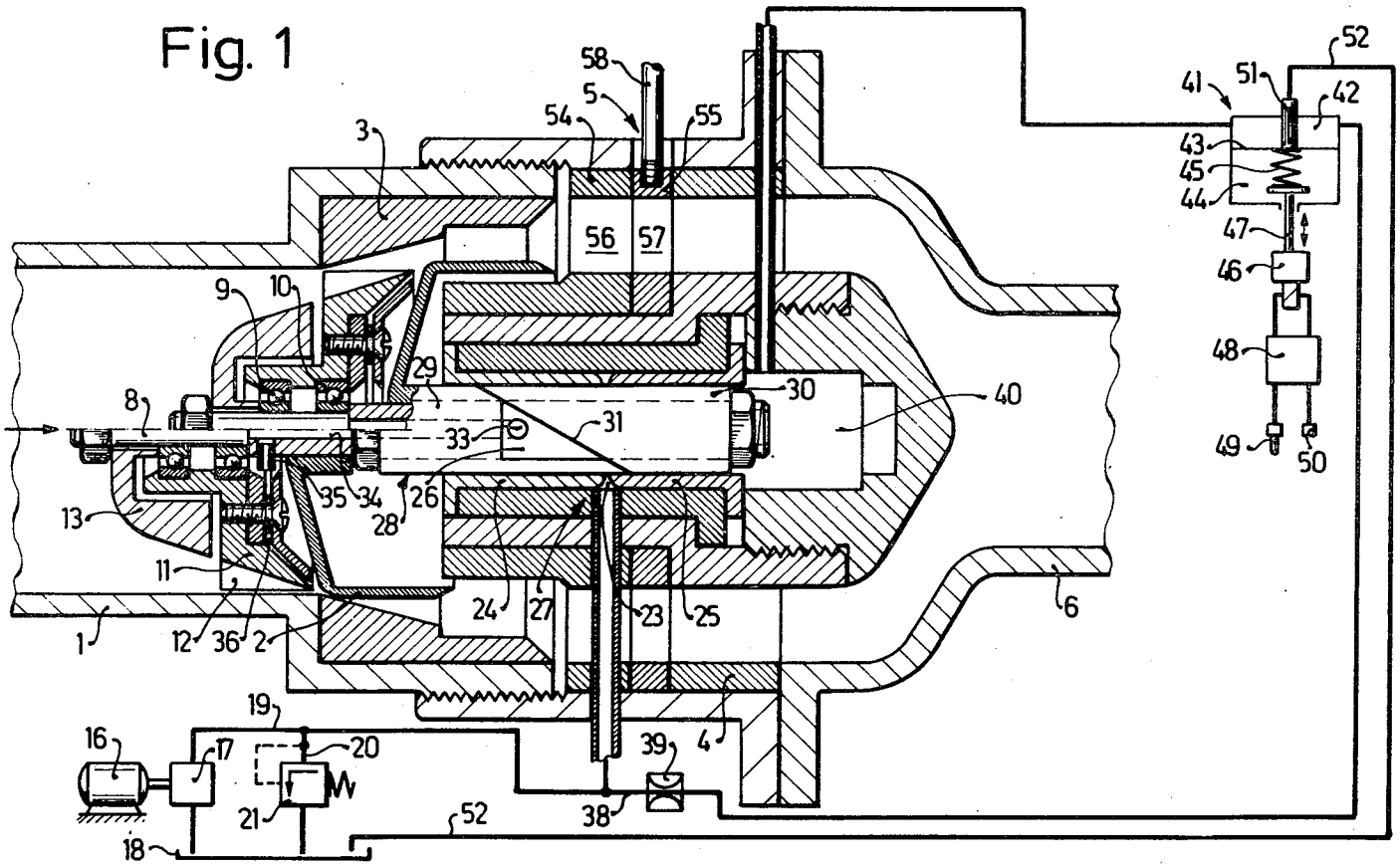
FIG. 1 is a sectional view of a first exemplary embodiment of a fuel metering valve assembly in conjunction with a fuel injection system.

Turning now to FIG. 1, there is illustrated schematically a fuel injection system in which the air necessary for the combustion in the engine flows in the direction of the arrow through an induction tube region 1 containing a baffle plate 2 acting as an air flow rate meter and disposed in a conical region 3 of the induction tube. The air continues through an induction tube region 4 containing an arbitrarily settable throttle assembly 5 and to an induction tube region 6 from which it flows to one or several cylinders of an engine, not shown. The baffle plate 2 is affixed to a bearing shaft 8 which is slidably disposed in suitable bearings within the induction tube. Upstream of the baffle plate 2, there is mounted on the bearing shaft 8 an impeller wheel 11 having vanes 12 and rotating on ball bearings 9, 10. An air-directing cone 13 is also mounted upstream of the baffle plate 2 on the bearing shaft 8.

The fuel injection system receives fuel from a fuel pump 17 driven by an electric motor 16 which takes fuel from a fuel container 18 and supplies it through a fuel supply line 19. Branching off from the supply line 19 is a line 20 which leads to a pressure limiting valve 21 for controlling the system fuel pressure and returns fuel to the fuel container 18. The fuel supply line 19 terminates in a control slot 23 defined between two partial bushings 24 and 25 surrounding the bearing shaft 8. A control orifice 26, to be further described, cooperates with the control slot 23 to constitute a fuel metering valve assembly 27. The triangular control orifice may be formed within the bearing shaft 8 or as illustrated may be formed in a sleeve 28 rigidly attached and surrounding the bearing shaft 8. In particular, the sleeve 28 may be constituted by two partial sleeves 29 and 30 which meet in an obliquely disposed line 31. The triangular control orifice 26 has one of its edges defined by the oblique line 31 and extends into the partial sleeve 29. It will be appreciated that, when the bearing shaft 8 is axially displaced within the induction tube, the triangular control orifice 26 exposes the control slot 23 to varying degrees. Depending on the relative overlap between the control slot 23 and the control orifice 26, the fuel metering assembly 27 meters out fuel which is taken through a radial bore 33 into an axial bore 34 within the bearing shaft 8 and then flows through a nipple 35 into a radial annular gap 36 within the impeller wheel 11. Due to the rotary motion of the impeller wheel, the fuel is moved radially outwardly and is expelled as a thin film of fuel in the vicinity of the periphery of the baffle plate 2 where the air flow velocity is at a maximum. The illustration of FIG. 1 shows the position of the baffle plate 2 and the impeller wheel for low engine load in the bottom part of the figure and for full engine load in the top part of the figure.

The baffle plate 2 which acts as an air flow meter is subject to a restoring force provided by pressurized fuel. For the purpose of supplying this pressurized fuel, a control pressure line 38 branches off from the main fuel supply line 19 and includes a decoupling throttle 39. The control pressure line 38 terminates in a pressure chamber 40 into which extends the downstream end-face of the bearing shaft 8. In order to adapt the fuel air ratio the varying operational conditions of the engine, it may be suitable to vary the return force acting on the baffle plate in dependence of engine conditions. This may be done by means of a pressure control valve 41 disposed within the control pressure line 38. The pressure control valve 41 includes a diaphragm 43 which defines a chamber 42 and a chamber 44. The chamber 44 includes a spring 45 which biases the pressure control valve 41 in the direction of closure and the force exerted by the spring may be changed in dependence on operational variables of the engine. For example, the force of the spring may be altered by means of an electromagnet 46 which engages the spring 45 via an actuating pin 47 or else additional forces may e exerted on the diaphragm 43 in parallel to the force of the spring 45 and depending on operating conditions. For example, the electromagnet 46 may be actuated by an electronic controller 48 which receives signals from an oxygen sensor 49 located in the exhaust system and/or from a temperature sensor 50. The force exerted on the diaphragm 43 could also be provided by a bimetallic spring in dependence on the operating temperature of the engine. The pressure control valve 41 is a flat seat valve in which the diaphragm 43 constitutes the movable valve member which cooperates with a fixed valve seat 51 through which fuel may flow back into the fuel container 18 via the return line 52.

The preparation of the fuel-air mixture may be further enhanced by providing that the throttle assembly 5 is constituted by two mutually rotatable, perforated rings 54 and 55. The perforated ring 54 is shown to be stationary and serves to hold and orient the bearing shaft 8 of the baffle plate. Its outer regions include preferably circular openings 56 which cooperate with preferably also circular openings 57 in the movable ring 55. The relative overlap of the holes in the two rings 54, 55 defines the effective flow cross section for the fuel-air mixture and thus constitutes the main throttle of the engine. The rotatable ring 55 may be rotated with respect to the fixed ring 54 by means of a pin 58 which is engaged in known manner by gas pedal linkage. The renewed decrease of the effective flow cross section through the overlapping regions of the holes 56, 57 results in a further intimate admixture of the metered out fuel with the aspirated air and thus causes an additional improvement of the fuel-air mixture preparation.

Figure 2:
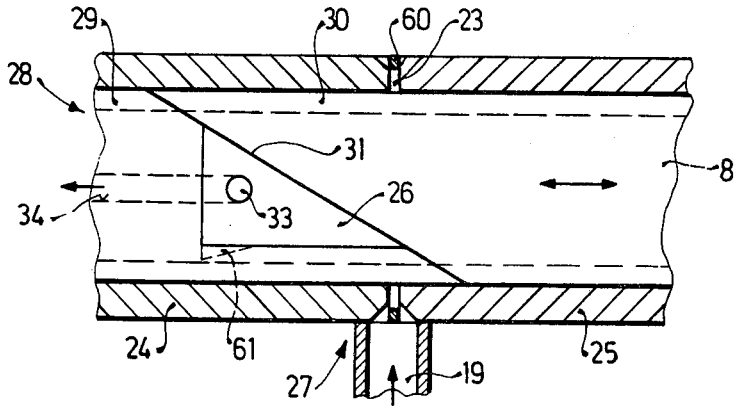
FIG. 2 is an enlarged portion of the fuel metering assembly of FIG. 1.

An enlarged portion of the fuel metering valve assembly 27 is illustrated in FIG. 2. The control slot 23, as has already been described, is formed by the width of the gap between the partial bushings 24 and 25 which is defined by a spacer ring 60 disposed within the two partial bushings 24 and 25. This spacer ring 60 can be cheaply and simply produced as a pressed part yet guarantees an exact calibration of the size of the control slot 23. By splitting the bearing sleeve 28 into two partial sleeves 29, 30 and, in particular, by making the split by means of an oblique separating line 31 which is contiguous to one edge of the triangular control orifice 26, the two remaining sides of the triangular opening in the partial sleeve 29 can be easily machined, for example by punching, grinding or milling. In particular, one of the lateral surfaces of the triangular control orifice may be provided with a correcting contour 61, shown dashed, so as to obtain, for example, a richer fuel-air mixture at full engine load.

The fuel injection system illustrated in FIG. 1 operates as follows:

When the internal combustion engine is operating, the electric motor 16 drives the fuel pump 17 which then aspirates fuel from the fuel container 18 and delivers it through the main fuel supply line 19 to the fuel metering valve assembly 27. At the same time, the engine aspirates air through the induction tube and the flowing air causes the baffle plate 2 to be displaced in the axial direction from its normal position and against the restoring force generated by the pressurized fluid. The axial displacement of the baffle plate 2 entails an identical displacement of the bearing shaft 8 and its triangular control orifice 26, thereby exposing an increased cross section of the control slot 23. As a result, the fuel metering valve meters out an amount of fuel which is proportional to the aspirated air quantity. The fuel pressure upstream of the metering valve assembly 27 as well as the fluid pressure in the control pressure line 38 are held constant by pressure control valves, but these pressures may be changed in order to permit an adaptation of the fuel-air ratio to various operating conditions of the engine. The fuel metered out at the fuel metering valve assembly 27 flows through a radial bore 33, the central axial bore 34, the nipple 35 and the annular gap 36 in the impeller wheel 11 to the periphery of the baffle plate 2 where the air flow velocity is the greatest and is injected at this point into the flowing combustion air. This type of admixture results in an especially favorable preparation of the fuel-air mixture. By embodying the control orifice 26 as a triangle which cooperates with a control slot 23, it is possible to obtain a considerably improved resolution of the motion of the baffle plate and thus an improved precision of adapting the metered out fuel to the requirements of the engine.

The essential functions of the fuel metering valve assembly 27 may also be performed if the relative dispositions of the control slot and the control orifice are reversed, for example in such a way that the control slot is disposed in a sleeve mounted on the bearing shaft 8, preferably formed by the line separating two partial sleeves. The width of such a control slot may be defined by a spacer disc which is clamped between the two partial sleeves and has a somewhat smaller diameter than the partial sleeves themselves. This control slot then cooperates with a control orifice in the wall of the bearing shaft 8 to varying degrees of overlap. Advantageously, the control orifice in the wall of the bearing shaft would then be triangular. In similarity with FIG. 1, the triangular control orifice may be defined by two partial bushings with an oblique separating line in which the triangular control orifice has one of its edges contiguous with the oblique separating line between the two partial bushings. Fuel supply and the manner of fuel injection would be similar to that already described with respect to the exemplary embodiment of FIG. 1.

Figure 3:
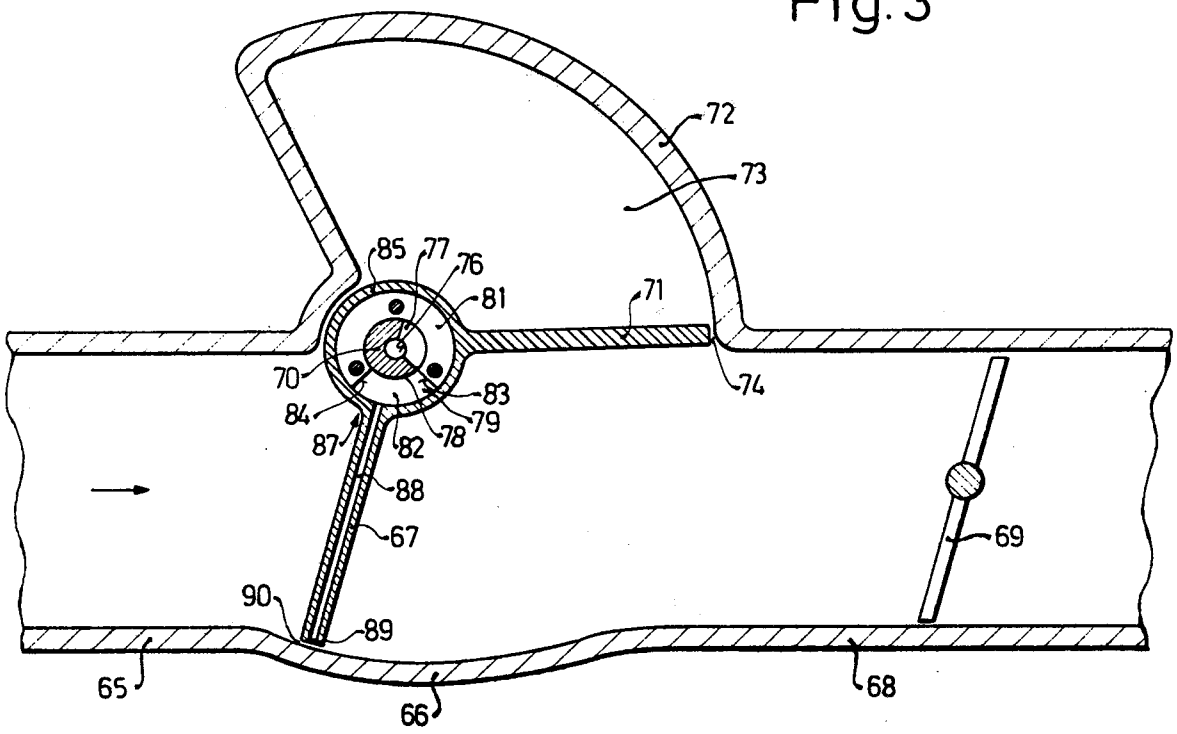
FIG. 3 is a sectional illustration of a second exemplary embodiment of a fuel metering valve according to the invention.

A second embodiment of the invention is illustrated in FIG. 3 which shows a portion of a fuel injection system wherein the air necessary for combustion flows in the direction of the arrow through an air filter, not shown, into an induction tube 65 having a region 66 within which is disposed an air flow rate meter embodied as a baffle plate 67. The air then continues through an induction tube region 68 containing a throttle valve 69 to one or more cylinders of an engine, not shown. The baffle plate 67 is displaced within the region 66 of the induction tube 65 according to an approximately linear function of the air flow rate through the induction tube. If the air pressure ahead of the member 67 is constant, then the air pressure between that member and the throttle valve will also be constant. The baffle plate 67 is mounted pivotably about a locally fixed shaft 70 and is provided with damping flap 71 which enters a damping section 72 of the induction tube when the baffle plate 67 is opened. The variable chamber 73 defined between the damping flap 71 and the wall of the induction tube 72 communicates through a small air gap 74 with the induction tube downstream of the baffle plate 67. The presence of the damping flap eliminates any effect of the suction pulses of the engine on the angular position of the baffle plate 67.

Figure 4:
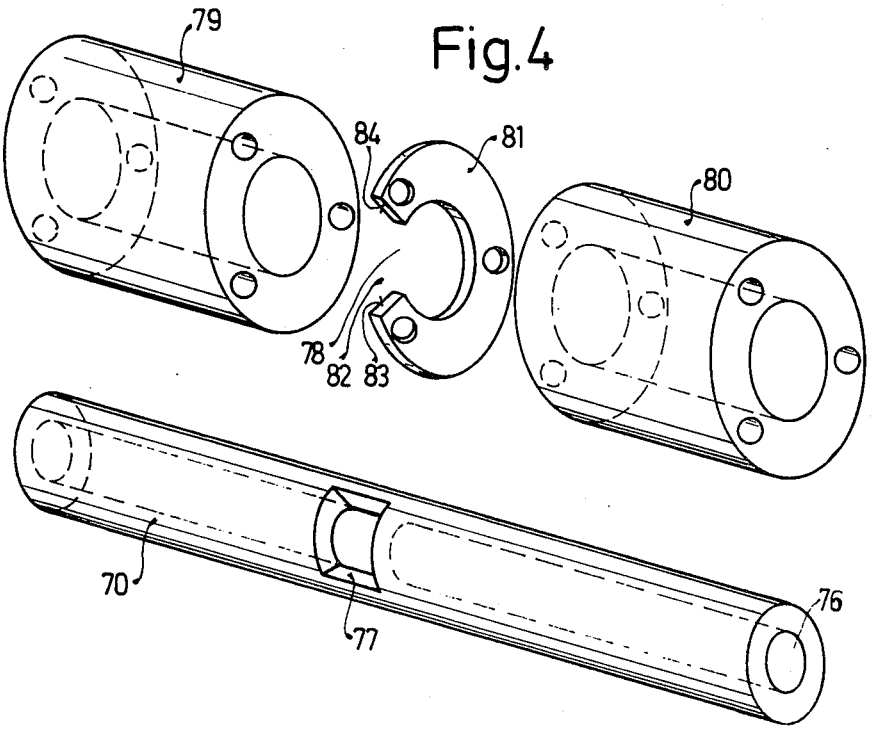
FIG. 4 is an exploded detailed illustration of elements of the valve shown in FIG. 3.

Fuel may be supplied to this injection system as was explained with respect to FIG. 1, in which case the fuel supply line 19 terminates in an axial bore of the shaft 80. The shaft 70 has a radial control orifice 77 which is exposed to varying degrees by a control slot 78 during rotary motions of the baffle plate 67. As shown more clearly in the exploded view of FIG. 4, the width of the control slot 78 is defined by the separating gap between two partial bushings 79 and 80 which are separated by a spacer ring 81 and its peripheral extent is defined by radial limiting surfaces 83, 84. The partial bushings 79 and 80 and the spacer ring 81 may be clamped together by suitable bolts which pass through axial perforations in these two parts. The partial bushings 79 and 80 which are clamped together with the spacer ring 81 define a bearing which is fixedly located within the hub 85 of the baffle plate 67. The control orifice 77 and the control slot 78 together define a fuel metering valve assembly 87, the effective size of which is directly determined by the motion of the baffle plate 67. The fuel metered out corresponding to the relative overlap of the control slot 78 and the control orifice 77 flows through the open section 82 of the spacer ring 81 into a bore 88 within the baffle plate 67 which terminates at the extreme edge of the baffle plate 67 in a gap 90 defined between the terminal edge of the baffle plate 67 and the wall of the induction tube 66 and in which the air flow velocity is a maximum. The spacer ring 81 insures a precisely calibrated width of the control slot 78 yet this ring may be produced in a simple manner as a pressed or punched part. The return force for the baffle plate 67 may be provided by a helical spring, not shown.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. A fuel metering valve assembly for an internal combustion engine, said engine including an air induction tube within which are disposed, seriatim, an air flow rate member and a throttle member, and including means for applying a return force to said air flow rate member to act in opposition to the force of the air flowing through said induction tube, and wherein said air flow rate member actuates said fuel metering valve assembly to control the amount of fuel metered out by said fuel metering valve assembly, and wherein the improvement comprises:

said fuel metering valve assembly includes a first part which is disposed in said induction tube and is movable therein and defines a first opening and includes a second part which is disposed in said induction tube and is stationary with respect thereto and defines a second opening, said first and second openings cooperating by mutual overlap to define an effective cross section for fuel flow, said first part being an axially slidable shaft and said second part being a bushing surrounding said shaft, said bushing being formed by at least two coaxial bushing elements which are separated in the axial extent by a gap which defines said second opening.

2. A fuel metering valve assembly as defined by claim 1, further comprising a spacer ring disposed between said bushing elements to define said gap.

3. A fuel metering valve assembly as defined by claim 1, wherein said first opening is triangular in shape.

4. A fuel metering valve assembly as defined by claim 3, wherein said triangular first opening is disposed in the wall of said slidable shaft.

5. A fuel metering valve assembly as defined by claim 3, further comprising a sleeve coaxial with and surrounding said slidable shaft and fixedly attached thereto, and wherein said triangular first opening is disposed in said sleeve.

6. A fuel metering valve assembly as defined by claim 5, wherein said sleeve is composed of two coaxial sleeve elements respective end faces of which meet in a plane oblique with respect to the axis of said slidable shaft thereby defining an oblique line of separation and wherein said triangular first opening is located in one of said sleeve elements and wherein one side of said triangular first opening is defined by a part of said oblique separating line.

7. A fuel metering valve assembly as defined by claim 6, wherein at least one of the lateral surfaces of said first opening is provided with a curved surface for the purpose of correcting the amount of fuel admitted.

8. A fuel metering valve assembly as defined by claim 7, in which the improvement further comprises said slidable shaft having an axial central bore communicating through a radial bore with said first opening and further comprising means for injecting fuel from said axial bore into said induction tube.

9. A fuel metering valve assembly as defined by claim 1, further comprising a spacer ring disposed between said two coaxial bushing elements, said spacer ring having an open sector defined by radial limiting faces, thereby determining the length of said second opening.

10. A fuel metering valve assembly as defined by claim 9, wherein said first opening is disposed in the wall of said sliding shaft.

11. A fuel metering valve assembly as defined by claim 10, wherein said slidable shaft has an axial central bore which communicates with said first opening in the wall of said sliding shaft.

12. A fuel metering valve assembly as defined by claim 9, including conduit means for carrying fuel from said sector of said spacer ring to said induction tube for the purpose of injecting fuel therein.

13. A fuel metering valve assembly for an internal combustion engine, said engine including an air induction tube within which are disposed, seriatim, an air flow rate member and a throttle member, and including means for applying a return force to said air flow rate member to act in opposition to the force of the air flowing through said induction tube, and wherein said air flow rate member actuates said fuel metering valve assembly to control the amount of fuel metered out by said fuel metering valve assembly, and wherein the improvement comprises:

said fuel metering valve assembly includes a first part which is disposed in said induction tube and is movable therein and is formed by an axially slidable shaft, and further comprises a split sleeve forming partial sleeves coaxial with and surrounding said sliding shaft and disposed to move therewith and further including a second part which is disposed in said induction tube and is stationary with respect thereto, said second part being a bushing surrounding said shaft and said split sleeve, and being formed by at least two coaxial bushing elements and a spacer ring disposed between said two bushing elements to define a gap therebetween.

14. A fuel metering valve assembly as defined by claim 13, wherein said split sleeves define a second opening which movably overlaps said gap.

15. A fuel metering valve assembly as defined by claim 14, wherein said partial sleeves meet along an oblique line with respect to the axis of said slidable shaft and wherein said second opening defined in said partial sleeves is a triangular opening one side of which is defined by a portion of said oblique line of separation between said partial sleeves.

16. A fuel metering valve assembly as defined by claim 15, wherein said slidable shaft has an axial bore which communicates with said gap and serves to transport fuel from said gap to said induction tube.

* * * * *